US006239417B1

(12) United States Patent
Vidmar et al.

(10) Patent No.: US 6,239,417 B1
(45) Date of Patent: May 29, 2001

(54) MICROWAVE HEATED SERVING UTENSIL

(75) Inventors: James F. Vidmar, Willoughby, OH (US); Yading Wang, Mission Viejo; Robert S. Rheinish, Trabuco Cyn, both of CA (US); Peter Rimback, S. Euclid, OH (US)

(73) Assignee: Hanover Catalog Holdings, Inc., Weehawken, NJ (US)

( * ) Notice: Subject to any disclaimer, the term of this patent is extended or adjusted under 35 U.S.C. 154(b) by 0 days.

(21) Appl. No.: 09/365,074

(22) Filed: Jul. 30, 1999

Related U.S. Application Data

(63) Continuation of application No. 09/243,577, filed on Feb. 3, 1999.

(60) Provisional application No. 60/091,445, filed on Jul. 1, 1998.

(51) Int. Cl.[7] ..... H05B 6/64
(52) U.S. Cl. ..... 219/725; 219/730
(58) Field of Search ..... 219/725, 757, 219/759; D7/681, 646, 691, 692; 30/324; 294/55; 425/276, 279, 283

(56) References Cited

U.S. PATENT DOCUMENTS

| | | | |
|---|---|---|---|
| D. 184,076 | 12/1958 | Wheaton | D44/29 |
| D. 186,853 | 12/1959 | Reichow | D44/29 |
| D. 242,976 | 1/1977 | Mason | D7/100 |
| D. 293,966 | 2/1988 | Baungratz | D2/293 |
| D. 294,101 | 2/1988 | Steinko | D7/100 |
| D. 305,852 | 2/1990 | Clement et al. | D7/681 |
| D. 312,749 * | 12/1990 | Kessler | D7/395 |
| D. 318,988 | 8/1991 | Antonacci | D7/681 |
| D. 329,784 | 9/1992 | Wong | D7/681 |
| D. 332,378 | 1/1993 | Thomas, Jr. et al. | D7/681 |
| D. 335,070 | 4/1993 | Empie | D7/681 |
| D. 342,867 | 1/1994 | Wong | D7/681 |
| D. 371,283 | 7/1996 | Cooper | D7/681 |
| D. 371,284 | 7/1996 | Reinier, Jr. et al. | D7/681 |
| D. 390,758 | 2/1998 | Henry et al. | D7/681 |

(List continued on next page.)

FOREIGN PATENT DOCUMENTS

| | | | |
|---|---|---|---|
| 0276654 | 8/1988 | (EP) | B05D/5/12 |

*Primary Examiner*—Teresa Walberg
*Assistant Examiner*—Quang Van
(74) *Attorney, Agent, or Firm*—Thompson Hine & Flory LLP

(57) ABSTRACT

A method for serving a frozen confection includes the steps of: (a) providing a utensil including a bowl portion formed from a substantially rigid material that becomes heated when subjected to microwave radiation in a conventional microwave oven and including a handle portion attached to the bowl portion, formed from a substantially rigid material that substantially restricts the absorption of microwave energy; (b) subjecting the utensil to microwave energy for a predetermined period of time, so that the bowl portion becomes heated; and (c) manually gripping the handle portion of the utensil to scoop the frozen confection with the heated bowl portion.

7 Claims, 5 Drawing Sheets

U.S. PATENT DOCUMENTS

| | | | | |
|---|---|---|---|---|
| D. 391,811 | | 3/1998 | Molo | D7/681 |
| 2,012,637 | | 8/1935 | Ribley | 30/22 |
| 2,091,777 | | 8/1937 | Daenba | 30/340 |
| 2,174,388 | | 8/1939 | Myers | 30/328 |
| 2,210,623 | | 8/1940 | Kelly | 107/48 |
| 2,560,900 | | 7/1951 | Shultz | 107/48 |
| 2,576,388 | | 11/1951 | Claflin | 30/327 |
| 2,785,641 | | 3/1957 | Wosse | 107/48 |
| 3,270,368 | * | 9/1966 | Cook et al. | 452/105 |
| 3,421,456 | * | 1/1969 | Weinstein | 425/164 |
| 3,809,520 | | 5/1974 | Wilk et al. | 425/276 |
| 3,822,976 | | 7/1974 | Moonan | 425/286 |
| 4,161,381 | | 7/1979 | Sciortino | 425/286 |
| 4,210,124 | | 7/1980 | Husslein et al. | 126/390 |
| 4,386,900 | | 6/1983 | Sultan | 425/279 |
| 4,392,806 | | 7/1983 | Houle | 425/286 |
| 4,542,271 | | 9/1985 | Tanonis et al. | 219/10.55 |
| 4,553,921 | | 11/1985 | Lamphere et al. | 425/279 |
| 4,562,921 | | 1/1986 | Leemkuil et al. | 198/841 |
| 4,699,582 | | 10/1987 | Chen | 425/187 |
| 4,721,449 | | 1/1988 | Alberts | 425/187 |
| 4,743,726 | | 5/1988 | Hughes et al. | 219/10.55 |
| 4,864,089 | | 9/1989 | Tighe et al. | 219/10.55 |
| 4,866,235 | | 9/1989 | Griffin et al. | 219/10.55 |
| 4,914,717 | | 4/1990 | Gibbon | 219/10.55 |
| 4,931,608 | | 6/1990 | Bills | 219/10.55 |
| 4,933,193 | | 6/1990 | Fisher | 426/107 |
| 4,963,708 | | 10/1990 | Kearns et al. | 219/10.55 |
| 4,983,798 | | 1/1991 | Eckler et al. | 219/10.55 |
| 4,984,367 | * | 1/1991 | Albannese | 30/147 |
| 5,000,672 | | 3/1991 | Halimi | 425/279 |
| 5,006,405 | | 4/1991 | Watkins et al. | 428/323 |
| 5,014,434 | * | 5/1991 | Skerker et al. | 30/345 |
| 5,070,223 | | 12/1991 | Colasante | 219/10.55 |
| 5,131,832 | | 7/1992 | Budreau | 425/277 |
| 5,360,964 | | 11/1994 | Park | 219/689 |
| 5,368,465 | | 11/1994 | Wanderer | 425/187 |
| 5,508,498 | | 4/1996 | Rheinish et al. | 219/730 |

* cited by examiner

MICROWAVE HEATED SERVING UTENSIL

CROSS-REFERENCE TO RELATED APPLICATIONS

This application is a continuation of application Ser. No. 09/243,577, filed Feb. 3, 1999, which claims priority under 35 U.S.C. §119 from Provisional Application Ser. No. 60/091,445, filed Jul. 1, 1998.

BACKGROUND

The present invention relates to utensils for serving frozen confections, and more particularly, to ice cream scoops which can be heated in a microwave oven.

It is often awkward and requires considerable effort to scoop cold and hard ice cream from its container utilizing conventional ice cream scoops. However, it is known the scooping process can be facilitated by heating the ice cream scoop so that the heated portion of the ice cream scoop will act to melt the hard ice cream it contacts, thereby making it easier for a person to scoop the ice cream. For example, U.S. Pat. No. 3,809,520 discloses an ice cream scoop that contains an interior fluid passage having an outlet for heated fluid transfer. A disadvantage with this device is that it is not a practical method for consumer use. U.S. Pat. Nos. 3,992,604, 4,553,921 and 5,000,672 each disclose electrically heated ice cream scoops with heating elements disposed inside the scoop or bowl portion. The disadvantage with these devices is that they may pose electrical hazards when powered by 110VAC in addition to the inconvenience of having to fumble with a power cord. Furthermore, the initial warm up will often be slow since an internal resistance heating element must first be heated, then that element heat passed through an insulating layer to the scoop surface. If batteries are used with electric scoop devices, the warm-up time would be even longer. U.S. Pat. No. 5,131,832 discloses an ice cream scoop that may be heated with the hot air generated by a butane lighter. A disadvantage with that device is that it is awkward and inconvenient, it requires an open flame and furthermore, the lighter can tend to easily overheat the scoop.

Accordingly, there is a need for an ice cream scoop which facilitates convenient, rapid and safe heating of the bowl-shaped scoop portion of the utensil. There is also a need for providing a method for constructing such an ice cream scoop inexpensively and efficiently.

SUMMARY OF THE INVENTION

The present invention is a serving utensil, which in a preferred embodiment is in the form of an ice cream scoop that can be heated in a conventional or home microwave oven to facilitate scooping a frozen confection from a container. The serving utensil includes a bowl portion formed from a substantially rigid material which absorbs microwave energy and converts the microwave energy to heat, and a handle portion, attached to the bowl portion, and formed from a material which does not appreciably absorb microwave energy.

In a preferred embodiment, the handle portion has a recess on its upper side, adjacent to the bowl portion, adapted to receive a user's thumb; and the handle portion also has a laterally extending groove on its underside, longitudinally aligned with the recess to receive a user's index finger. It is important that these ergonomic elements are positioned in the non-microwave absorbing handle portion so that the user does not have to touch the heated portion of the scoop when scooping ice cream.

In use, the utensil is placed within a microwave oven and subjected to microwave energy for a predetermined period of time. Because only the bowl portion includes microwave absorbing material, only the bowl portion will become heated. Once the heating process is finished, the utensil can be removed from the oven by its relatively cool handle portion and used to serve ice cream easily and efficiently because the heated portion softens the ice cream it contacts, thus facilitating the scooping action with enhanced lubrication and reduced force.

Preferably, the underside of the handle portion also includes a plurality of nubs, spaced from the bowl portion, the thumb recess and the index finger groove, which enhance the grip of the handle portion. The underside of the handle segment preferably also includes a second transverse extending groove, adjacent to the index finger groove and opposite the bowl portion., which is adapted to receive at least the user's middle finger. A finger grip separates the two grooves and is shaped to be gripped by the index finger during scooping, thereby reducing the effort required to grip the scoop effectively and increasing the amount of leverage which may be applied by the user.

The handle portion also preferably includes a substantially longitudinally-extending bore extending into the forward end of the handle portion, and the bowl portion includes a plug received within and bonded to the longitudinally-extending bore of the handle portion, thereby improving the durability of the attachment between the handle portion and the bowl portion. The plug extending from handle portion preferably includes a plurality of radially extending ribs which increase the surface area of the plug, thereby facilitating a better bond between the bowl portion and the handle portion and also improving heat dissipation from the bowl portion into the handle portion. The plug preferably is cruciform in cross-section and is mechanically bonded to the handle portion within the bore by injection molding the handle portion over the plug of the bowl portion. The plug of the bowl portion may also be bonded to the handle portion, within the bore of the handle portion, using an adhesive.

Another aspect of the present invention provides a method for constructing a serving utensil for serving frozen confections comprises the steps of: (a) providing a bowl segment of a substantially rigid material which absorbs microwave energy and converts the microwave energy to heat, where the bowl portion includes a plug extending outwardly from a radial side of the bowl portion; and (b) injection molding a non-microwave absorbing, thermoplastic handle over the plug of the bowl portion. Preferably, the bowl portion is molded from a microwave absorbing, acetal polymer material. Furthermore, the step of molding the bowl portion may also include a step of introducing a filler material into the microwave-absorbing, acetal polymer material so as to slow the heating rate and to increase the melting point of the microwave-absorbing bowl portion.

Another embodiment of the present invention provides a method for constructing a serving utensil for serving frozen confections that comprises the steps of: (a) providing a bowl portion of a substantially rigid material which absorbs microwave energy and converts it to heat, where the bowl portion includes a plug extending outwardly from a radial side thereof; (b) providing a handle portion of a substantially rigid, non-microwave absorbing material, which substantially restricts the absorption of microwave energy, where the handle portion includes a substantially axially extending bore extending into a longitudinal end thereof; and (c) bonding the plug of the bowl portion within the bore of the handle portion. This bonding step can be performed by injection molding the handle portion over the plug extending from the bowl portion or can occur by including the step of applying an adhesive material between the plug and the bowl portion and the bore of the handle portion.

Accordingly, it is an object of the present invention to provide a serving utensil for dispensing frozen confections that allows quick, efficient and safe heating of the bowl portion of the utensil, while providing an ergonomic handle which remains substantially cool to the touch; a microwave heated serving utensil that is rugged in construction; a microwave heated serving utensil that is relatively simple and inexpensive to construct; and a microwave heated ice cream scoop, where the handle is constructed to provide optimum gripping and leverage for a user. These and other objects and advantages of the present invention will be apparent from the following description, the appended claims and the accompanying drawings.

DETAILED DESCRIPTION OF THE INVENTION

Figure 1:
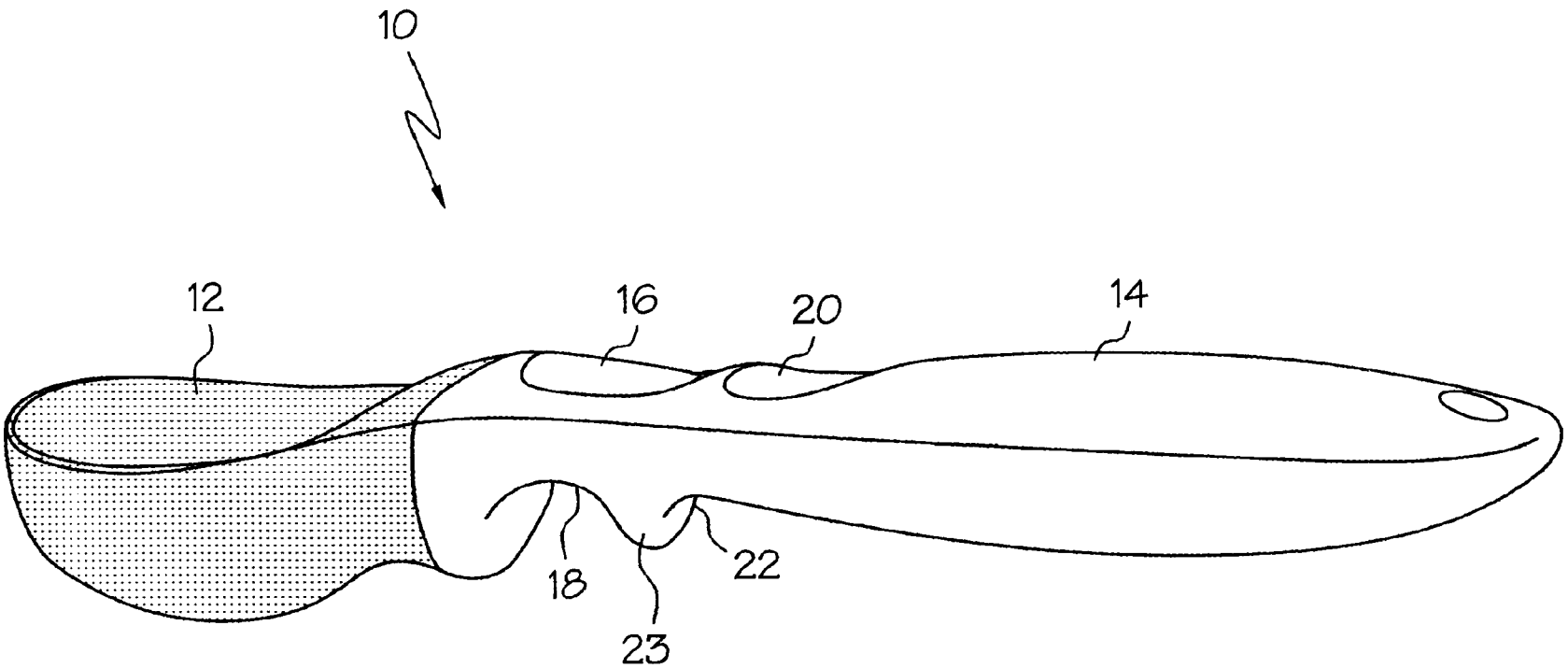
FIG. 1 is a perspective view of a preferred embodiment of the microwave heated ice cream scoop of the present invention.
Figure 2:
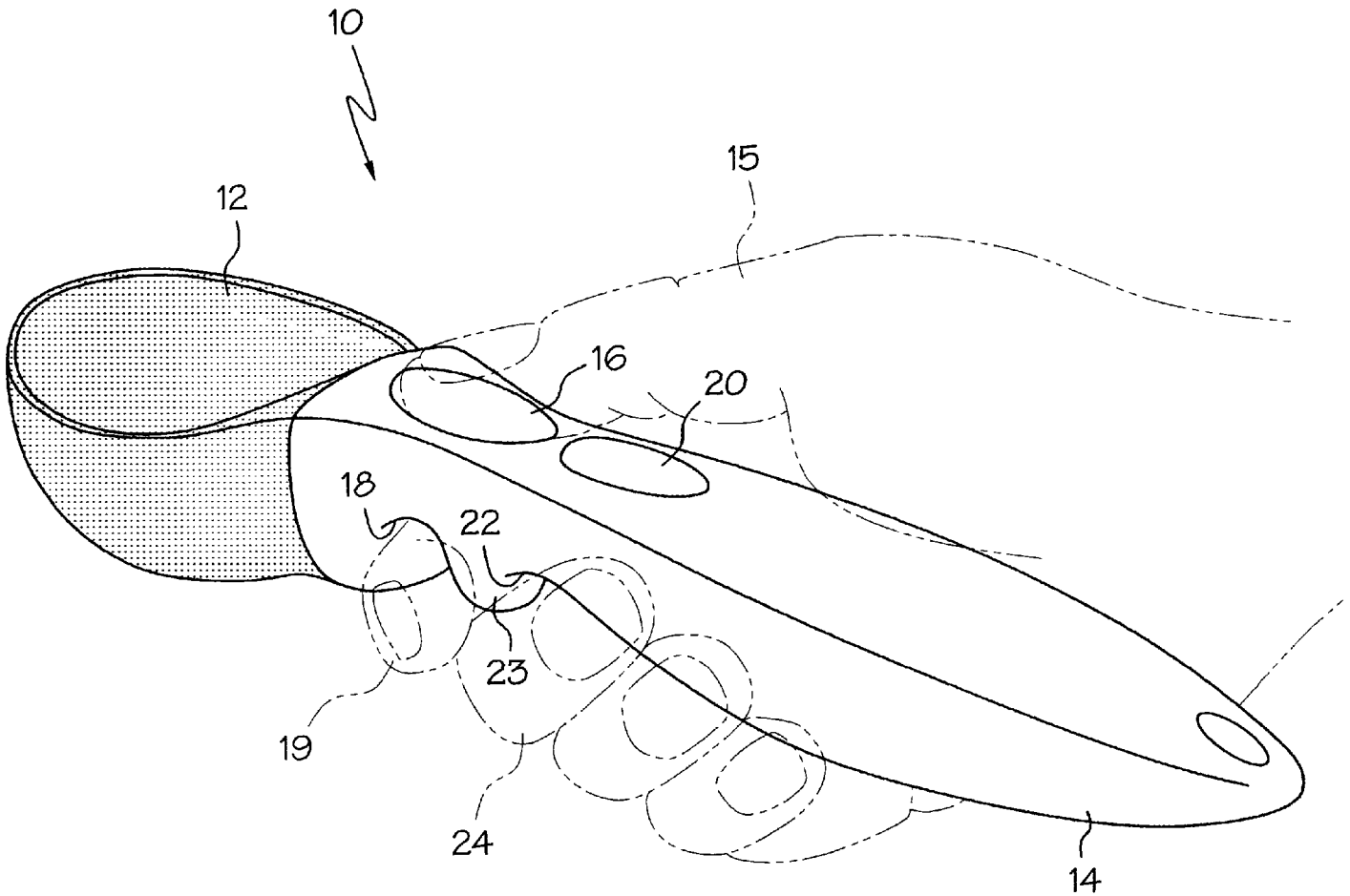
FIG. 2 is a perspective view of the scoop of FIG. 1 illustrating how a user's hand grips the handle portion.

As shown in FIGS. 1 and 2, the present invention is an ice cream scoop (10) that can be safely heated in a microwave oven before scooping a frozen confection, such as ice cream. The scoop (10) includes a bowl portion (12) made from a material which absorbs microwave energy and converts it to heat. The material of the bowl portion (12) also retains such heat energy for a period of time sufficient to scoop a serving of ice cream. The scoop (10) includes a handle portion (14) made from a material which does not appreciably absorb microwave radiation, and therefore does not heat when exposed to microwave radiation. When heated in a microwave oven, the scoop (10) melts or softens the ice cream at the scoop/ice cream interface, thereby facilitating enhanced lubrication between the scoop and the ice cream, and reducing the force and effort required to scoop and serve the ice cream.

Preferably, the bowl portion (12) is molded from an acetal polymer material such as an acetal copolymer material or a acetal homopolymer material. An example of an acetal copolymer material for use with the present invention is Celcon® (trademark of Hoechst Celanese Corp., Chatham, N.J.). An example of an acetal homopolymer material is Delrin® (trademark of E.I. DuPont Denemoirs & Company). Such acetal polymer materials are capable of being injection molded, and thereby facilitate inexpensive and efficient manufacturing of the bowl portion (12). To increase the thermal stability of the bowl portion material, talc, glass or other suitable fillers may be incorporated therein.

Other suitable microwave energy absorbing materials which may be used in constructing the bowl portion (12) include polymers and thermosets loaded with microwave interactive fillers. Such fillers may include, but are not limited to, carbon black, graphite powder or grains, therite powder, activated carbon powder, iron powder or filings, steel powder or filings, copper particles or powder, and metallic powders or particles. The loadings of these fillers in the polymer composite preferably range from about 5% to about 80% by weight.

The handle portion (14) is preferably injection molded from a thermoplastic or thermosetting material which is generally not microwave interactive. Suitable non-microwave absorbing materials include ABS, acrylic, polyamide, polycarbonate, polyester, polypropylene, melamine-formaldehyde, phenolic, and urea-formaldehyde resins. To increase the rigidity of the handle portion (14), non-microwave absorbing fillers such as glass fibers may be incorporated therein. Furthermore, if desired, reinforcing fibers or materials may also be incorporated into the bowl portion (12).

The top side of the handle portion 14 includes a substantially teardrop-shaped recess (16) adjacent to the bowl portion (12) for receiving a user's thumb. On the underside of the handle portion (14), a laterally extending groove (18) is provided immediately under the thumb recess (16) for receiving the user's index finger (19). The thumb recess (16) and index-finger groove (18) are approximately ¼' to ½' (6.4 mm to 13 mm) from the bowl portion (12) to provide optimal leverage for the user, especially when scooping ice cream near the top of the carton. A second, transverse groove (22) is provided adjacent to the index groove (18) and a finger grip (23) separates the two grooves. This second groove (22) is shaped to receive the user's middle finger (24) and the finger grip (23) is provided to be gripped by a user's index finger during scooping, thus maximizing the amount of force which can be imparted to the ice cream scoop by the user.

Optionally, a second recess (20) may be provided substantially over the second groove (22). This second recess may be used to receive the user's thumb (15) and the second groove (22), in turn, may be used to receive the user's index finger (19) to space the bowl portion (12) a greater distance from the user's hand when, for example, the user is scooping ice cream near the bottom of the carton. This second recess (20) and second groove (22) are preferably positioned approximately 1½' to 2' (38 mm to 51 mm) from the bowl portion (12). As discussed above, it is important that the ergonomic gripping elements (16–23) are positioned in the non-microwave absorbing handle portion (14) so that the user does not come into contact with or touch the heated portion (12) of the scoop (10) when scooping ice cream. It should be apparent to those of ordinary skill in the art that while the recesses are described as teardrop shaped, it is within the scope of the invention to provide other ergonomic gripping elements on the handle that are especially adapted for receiving a user's thumb or fingers.

In practice, the handle portion (14) will preferably have an off-white color, while the bowl portion (12) will have a different color such as black, rose, mauve, etc., thereby giving the user visual indication that the handle is "cool" and that the bowl is "warm" after microwaving.

Figure 3:
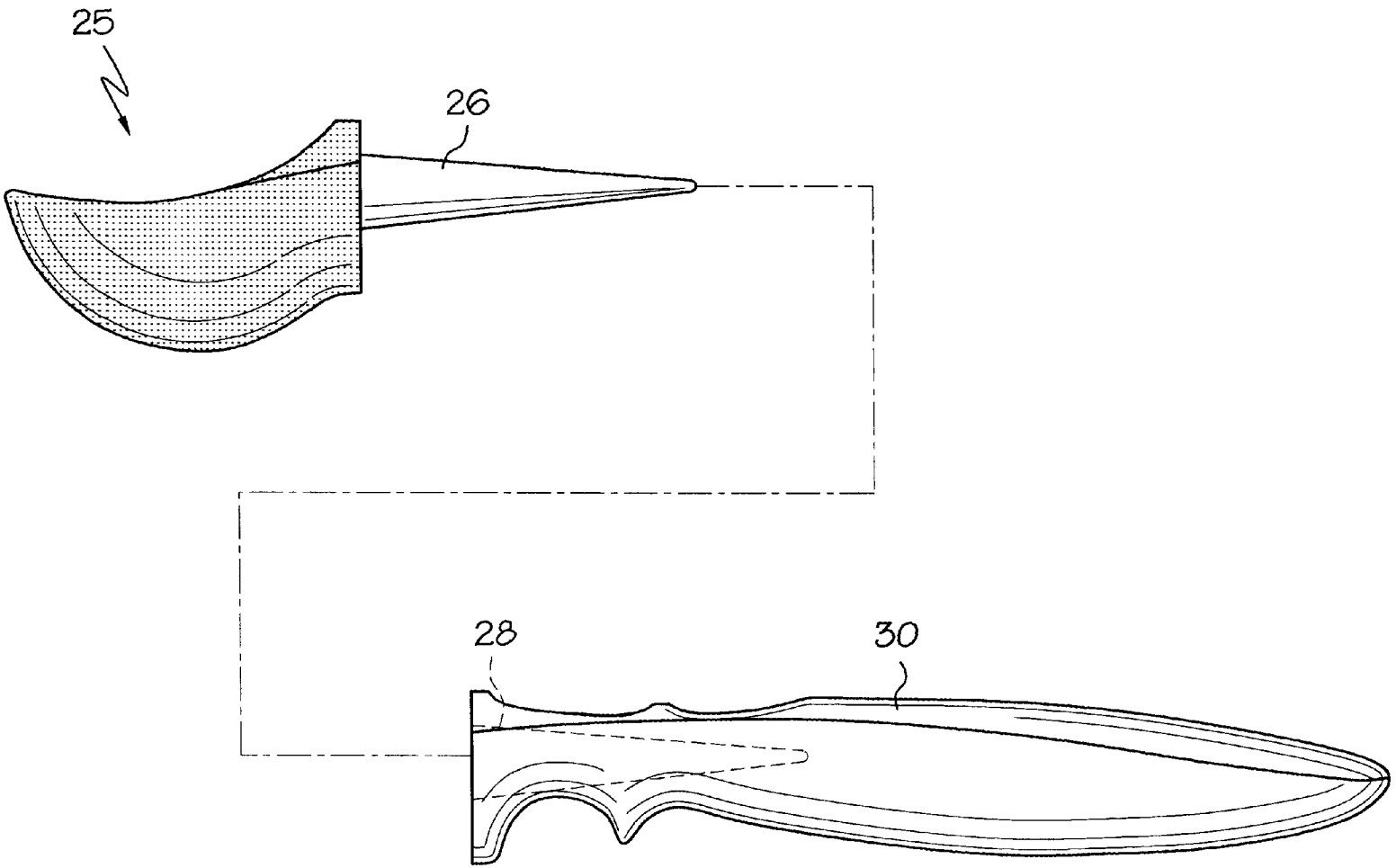
FIG. 3 is an exploded side view of the scoop of FIG. 1.

As shown in FIG. 3, the scoop (10) is assembled from two separate components: a bowl component (25) made of the microwave absorbing material and a handle component (30) made of the substantially non-microwave absorbing material. The bowl component (25) includes a rearwardly-extending plug (26) which is received within a corresponding bore (28) formed within the handle component (30). One method of constructing the scoop (10) from these two components is by molding each of the components (25), (30) separately, then applying adhesive between the plug (26) and the bore (28), thus adhesively bonding the two components (25), (30) together. In a preferred embodiment, the bowl component (25) is molded first and then the handle component (30) is injection molded over the plug (26), thereby effecting a mechanical bond between the bowl component (25) and the handle component (30). It is also within the scope of the invention to attach the two components (25), (30) using other means known to those of ordinary skill in the art, such as ultrasonic welding, adhesives (such as high-temperature/high-strength epoxy resins) and mechanical interlocks (such as snap-on or screw-on type components) as known to those of ordinary skill in the art.

Figure 4:
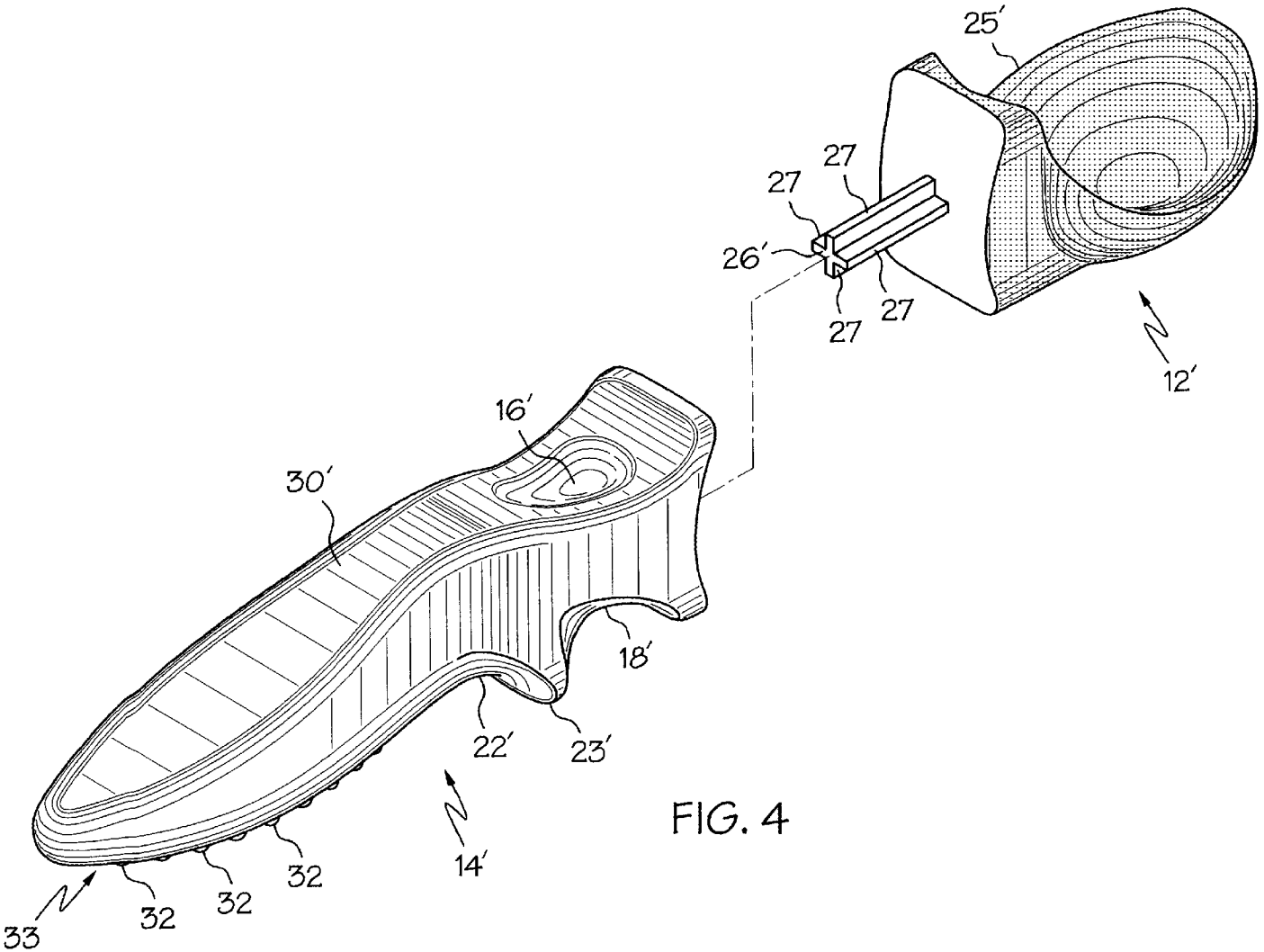
FIG. 4 is an exploded perspective view of an alternate preferred embodiment of the microwave heated ice cream scoop of the present invention.
Figure 5:
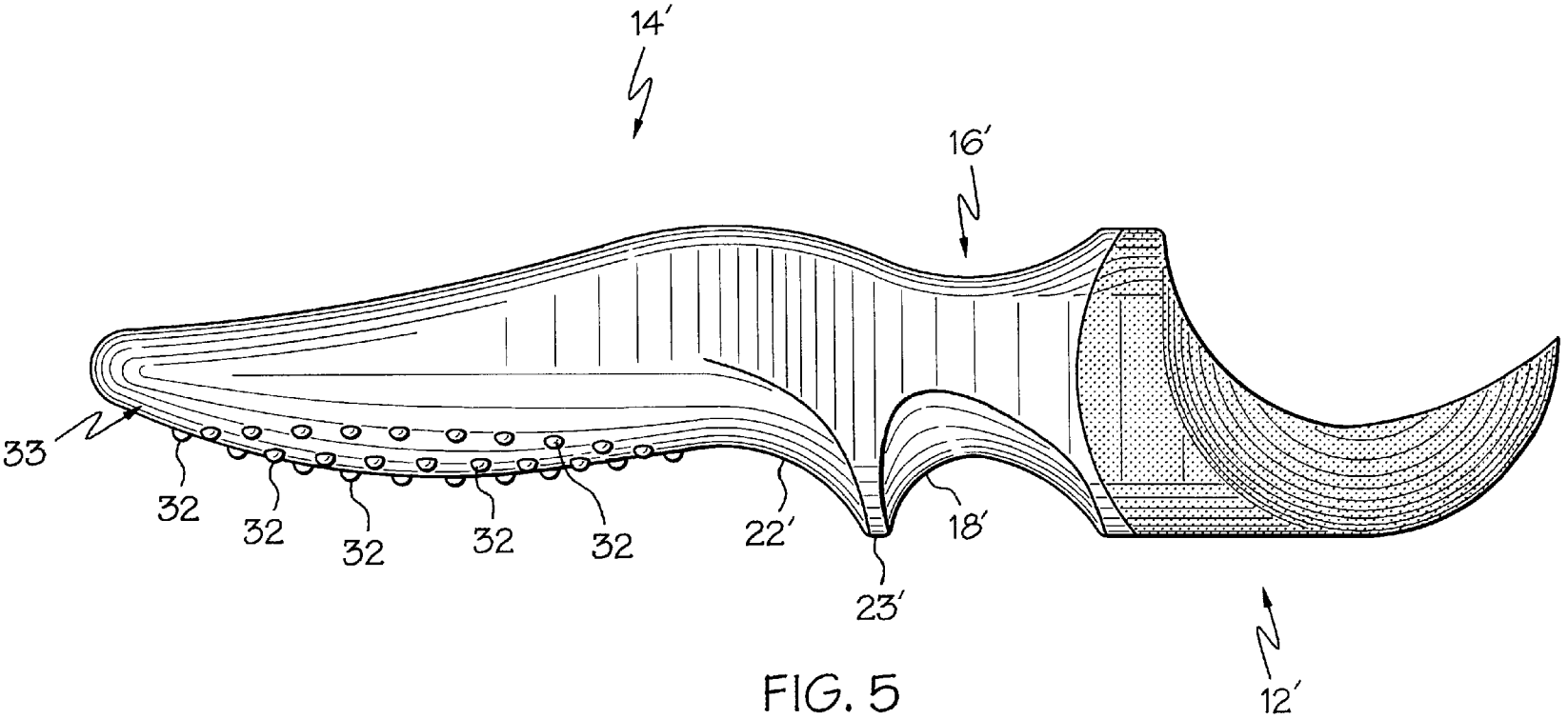
FIG. 5 is a side elevational view of the scoop shown in FIG. 4.

As shown in FIGS. 4 and 5, in an alternate embodiment of the present invention 10', the handle portion 14' includes a plurality of nubs (32) extending therefrom, at the end (33) of the handle portion opposite the bowl portion 12'. The nubs (32) are uniformly disposed on the underside of the handle portion 14' to enhance the user's grip. Furthermore, in this embodiment 10' a second recess in the upper side of the handle portion 14' is not provided, but the recess 16 is slightly longer than the recess in the first embodiment shown in FIGS. 1 and 2. Furthermore, in this embodiment, the plug 26' extending from the bowl component 25' has four radial ribs (27), providing a cruciform shape in cross-section to increase the surface area of the plug, thereby effecting a better bond between the bowl component and the handle component and also increasing the surface area of contact between the bowl and handle portions 12', 14', to improve heat dissipation from the bowl portion to the handle portion. Of course, the bore (not shown) in the handle 30' will also have a cruciform cross section to match the shape of the plug 26'. While this cruciform shape is preferred, any radial rib or plug extending from the plug 26' which increases the surface area of the plug 26' and/or facilitates a better mechanical bond between the bowl component 25' and the handle component 30', would fall within the scope of the invention. For example, more radial ribs can be used to provide a star-shaped cross section; or a plurality of radial spokes may extend outwardly therefrom. Furthermore, while a plurality of radial ribs or projections extending radially from the plug is preferred, it is within the scope of the invention to provide at least one radially extending rib or projection. Preferably the plug 26' in this embodiment is approximately 1' to 2' (25.4 mm to 5 mm) long and approximately ½' (13 mm) wide.

Having described the invention in detail and by reference to the drawings, it will be apparent that modification and variations are possible without departing from the scope of the invention as defined in the following claims.

What is claimed is:

1. A method for serving a frozen confection, comprising the steps of:

providing a utensil including a bowl portion formed from a substantially rigid material that becomes heated when subjected to microwave radiation in a conventional microwave oven and including a handle portion attached to the bowl portion, formed from a substantially rigid material that substantially restricts the absorption of microwave energy;

subjecting the utensil to microwave energy for a predetermined period of time, so that the bowl portion becomes heated; and manually gripping the handle portion of the utensil to scoop the frozen confection with the heated bowl portion.

2. The method of claim 1, wherein the gripping step includes the steps of placing a thumb in a recess positioned on an upper side of the handle portion, approximate the bowl portion and placing an index finger in a transverse groove positioned on a lower side of the handle portion, approximate the bowl portion.

3. The method of claim 1, wherein:

the utensil includes ergonomic elements positioned in the handle portion, providing leverage for a user when scooping the frozen confection; and the step of gripping the handle portion includes the step of gripping the ergonomic elements of the handle portion.

4. The method of claim 3, wherein the ergonomic elements include at least one transverse groove positioned on an under side of the handle portion and the step of gripping the handle portion includes the step of placing a finger in the transverse groove.

5. The method of claim 4, wherein the ergonomic elements include at least one recess on an upper side of the handle portion and the step of gripping the handle portion includes the step of placing a thumb in the recess.

6. The method of claim 3, wherein the ergonomic elements include a plurality of nubs positioned on an under-side of the handle portion and the step of gripping the handle portion includes the step of placing at least one finger over at least a portion of the nubs.

7. The method of claim 1, wherein the step of subjecting the utensil to microwave energy includes the step of placing the utensil in a conventional microwave oven and activating the oven for the predetermined period of time.

* * * * *